US009103099B2

(12) United States Patent
Cutler et al.

(10) Patent No.: US 9,103,099 B2
(45) Date of Patent: Aug. 11, 2015

(54) SURFACE EXCAVATION MACHINE

(75) Inventors: Edward Lee Cutler, Bloomfield, IA (US); Glenn Meinders, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 96 days.

(21) Appl. No.: 14/006,135

(22) PCT Filed: Mar. 21, 2012

(86) PCT No.: PCT/US2012/029921

§ 371 (c)(1), (2), (4) Date: Sep. 19, 2013

(87) PCT Pub. No.: WO2012/129290

PCT Pub. Date: Sep. 27, 2012

(65) Prior Publication Data

US 2014/0007465 A1 Jan. 9, 2014

Related U.S. Application Data

(60) Provisional application No. 61/454,883, filed on Mar. 21, 2011.

(51) Int. Cl.

| | |
|---|---|
| ***E02F 5/04*** | (2006.01) |
| ***E02F 3/78*** | (2006.01) |
| ***E02F 3/20*** | (2006.01) |
| ***E02F 5/08*** | (2006.01) |

(Continued)

(52) U.S. Cl.

CPC ... *E02F 3/78* (2013.01); *E02F 3/20* (2013.01); *E02F 3/815* (2013.01); *E02F 3/84* (2013.01); *E02F 5/08* (2013.01)

(58) Field of Classification Search

CPC ..... E02F 3/08; E02F 3/10; E02F 3/18; E02F 3/20; E02F 3/26; E02F 9/085; E02F 9/00; E02F 9/0808; E02F 3/78; E02F 3/815; E02F 3/84; E02F 5/08

USPC ..... 37/189, 387, 96, 464, 352; 299/36.1, 299/39.2, 39.4, 95; 172/247, 250

See application file for complete search history.

(56) References Cited

U.S. PATENT DOCUMENTS

| | | | |
|---|---|---|---|
| 1,472,563 | A | 10/1923 | Loken |
| 1,627,249 | A | 5/1927 | Page |
| 3,651,588 | A | 3/1972 | Hanson |

(Continued)

FOREIGN PATENT DOCUMENTS

| | | | |
|---|---|---|---|
| FR | 1 483 272 | A | 6/1967 |
| JP | 2001-164597 | A | 6/2001 |
| JP | 2010-037785 | A | 2/2010 |

OTHER PUBLICATIONS

International Search Report for corresponding International Patent Application No. PCT/US2012/029921 mailed Oct. 24, 2012.

(Continued)

*Primary Examiner* — Robert Pezzuto

(74) *Attorney, Agent, or Firm* — Merchant & Gould P.C.

(57) ABSTRACT

A low height pivot arrangement allows an excavation tool of a surface excavation machine to be pivoted between an upper transport position and a lower excavating position. The low height pivot arrangement assists in reducing a moment arm of the excavation tool when the excavation tool is raised during non-excavating operations.

10 Claims, 12 Drawing Sheets

(51) Int. Cl.
*E02F 3/815* (2006.01)
*E02F 3/84* (2006.01)

(56) References Cited

U.S. PATENT DOCUMENTS

| | | | | |
|---|---|---|---|---|
| 3,926,263 | A | 12/1975 | Frisbee et al. | |
| 4,041,623 | A | 8/1977 | Miller et al. | |
| 4,755,001 | A | 7/1988 | Gilbert | |
| 5,378,080 | A | 1/1995 | Dickson | |
| 5,404,660 | A * | 4/1995 | Webster | 37/189 |
| 5,846,026 | A | 12/1998 | Gilbert et al. | |
| 6,227,620 | B1 | 5/2001 | Page | |
| 6,547,336 | B2 | 4/2003 | Hoffmann | |
| 6,725,579 | B2 | 4/2004 | Unzicker et al. | |
| 6,948,265 | B2 | 9/2005 | Unzicker et al. | |
| 7,290,360 | B2 | 11/2007 | Unzicker et al. | |
| 2001/0038236 | A1 * | 11/2001 | Hoffmann | 299/36.1 |
| 2002/0056211 | A1 | 5/2002 | Kelly et al. | |
| 2004/0172864 | A1 | 9/2004 | Unzicker et al. | |
| 2006/0251349 | A1 | 11/2006 | Schmeling et al. | |

OTHER PUBLICATIONS

Dey, K. et al. "Predicting "cuttability" with surface miners—A rockmass classification approach", Journal of Mines, Metals and Fuels, vol. 56, No. 5-6, May 2008, pp. 85-91.
"Mechanical Excavation.doc", Mar./Apr. 2011, pp. 1-17, www.docstoc.com/docs/76837509/7-Mechanical-Excavation.
Supplementary European Search Report for corresponding European Patent Application No. 12761446 mailed Sep. 9, 2014.

* cited by examiner

SURFACE EXCAVATION MACHINE

This application is being filed on 21 Mar. 2012, as a PCT International Patent application in the name of Vermeer Manufacturing Company, a U.S. national corporation, applicant for the designation of all countries except the US, and Edward Lee Cutler and Glenn Meinders, citizens of the U.S., applicants for the designation of the US only, and claims priority to U.S. Provisional Patent Application Ser. No. 61/454,883, filed Mar. 21, 2011, which application is hereby incorporated by reference in its entirety.

TECHNICAL FIELD

The present disclosure relates generally to excavation equipment. More particularly, the present disclosure relates to surface excavation machines.

BACKGROUND

Surface excavation machines are used to level terrain and/or remove a layer of material from a given site location. Typical applications include surface mining, demolishing a road, and prepping a site for new construction or reconstruction. Surface excavation machines provide an economical alternative to blasting and hammering. Furthermore, surface excavation machines provide the advantage of generating a consistent output material after a single pass. Therefore, surface excavation machines can reduce the need for primary crushers, large loaders, large haul trucks and the associated permits to transport materials to crushers.

An example surface excavation machine includes a main chassis supporting an operator cab. The main chassis is supported on a ground drive system such as a plurality of tracks. An engine such as a diesel engine is mounted on the main chassis. The engine provides power for driving the various components of the machine. Often, the diesel engine powers a hydraulic system which includes various hydraulic motors and hydraulic cylinders included throughout the machine. An excavating tool is typically mounted at a rear end of the main chassis. The excavation tool can include a rotational excavating drum mounted on a pivotal boom. The excavating drum carries a plurality of cutting teeth suitable for cutting rock. An example surface excavation machine of the type described above is disclosed at U.S. Pat. No. 7,290,360, which is hereby incorporated by reference in its entirety.

Surface excavation machines are often used for extremely rugged applications. To accommodate such applications, pivotal interfaces for allowing tilting and pivoting of the excavating tools of surface excavation machines have been designed with extraordinarily robust, heavy-duty constructions. Such constructions are typically quite large, heavy and expensive to manufacture. Such constructions can negatively affect the maneuverability of surface excavation machines, particularly when the surface excavation machines are being maneuvered with the excavation tools raised during non-excavation operations.

SUMMARY

Certain aspects of the present disclosure relate to improved pivot arrangements for excavation tools of surface excavation machines.

Another aspect of the present disclosure relates to excavation tool pivot arrangements that are compact and concurrently robust enough to withstand rugged excavation applications.

Still another aspect of the present disclosure relates to an excavation pivot tool arrangement that allows for tilting and raising and lowering of the excavation tool, and that also allows the length of the excavation tool to have a reduced length thereby reducing a moment arm length of the excavation tool.

A further aspect of the present disclosure relates to a low height pivot arrangement for allowing an excavation tool of a surface excavation machine to be pivoted between an upper transport position and a lower excavating position. The low height pivot arrangement assists in reducing a moment arm of the excavation tool when the excavation tool is raised during non-excavating operations.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
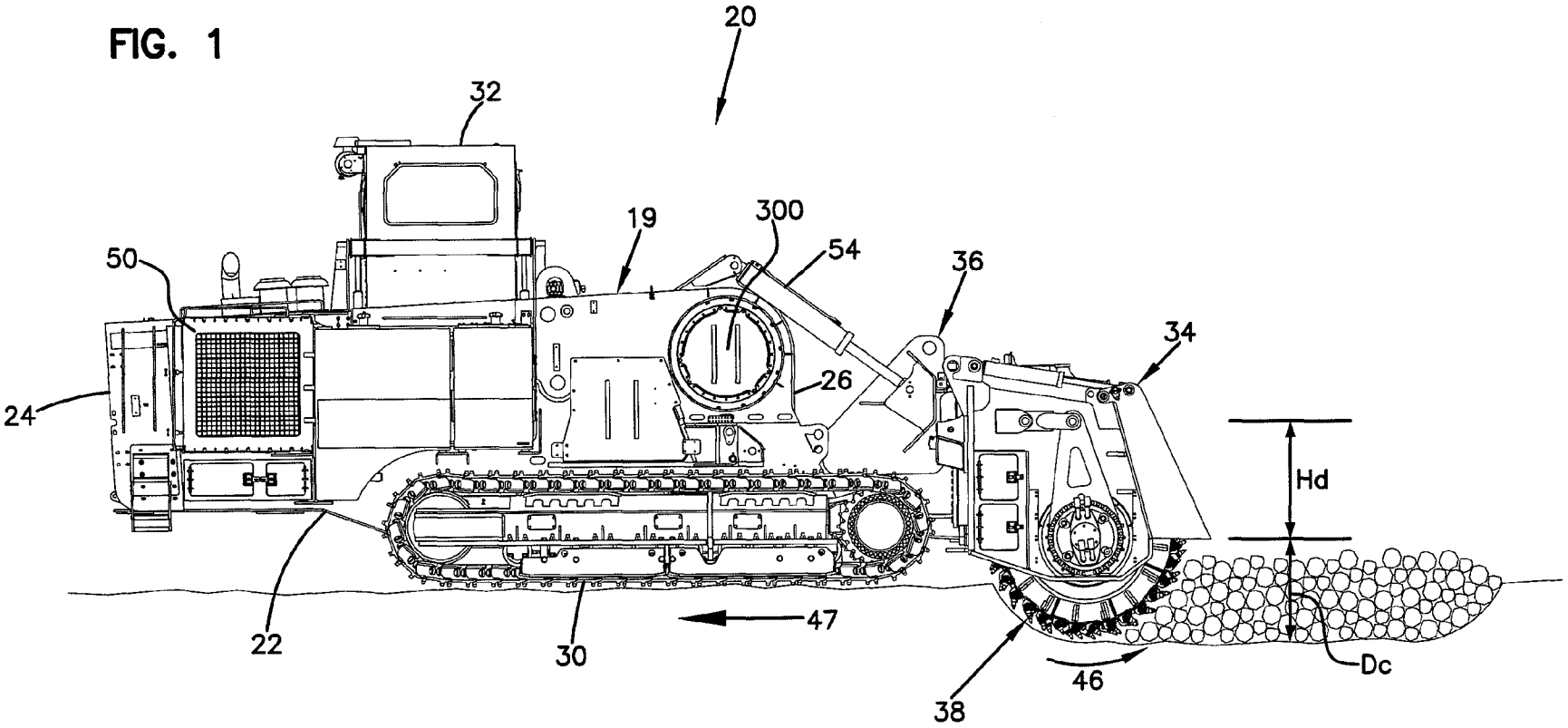
FIG. 1 is a side view of a surface excavation machine in accordance with the principles of the present disclosure, an excavation tool of the surface excavation machine is shown in an excavation position.

FIGS. 1-4 illustrate a surface excavation machine 20 in accordance with the principles of the present disclosure. The surface excavation machine 20 includes a tractor 19 having a main chassis 22 (i.e., a mainframe) including a front end 24 and a rear end 26. A central longitudinal axis 28 (see FIG. 3) of the surface excavation machine 20 extends between the front rear ends 24, 26 and bisects the machine 20. The main chassis 22 is supported on a ground drive system (i.e., a propulsion system) that preferably includes a plurality of propulsion structures such as wheels or tracks 30 for propelling the machine 20 over the ground. An operator cab 32 is mounted at a top side of the main chassis 22. An excavation tool 34 is mounted to the rear end 26 of the main chassis 22. The excavation tool 34 includes a boom 36 and an excavation drum 38 mounted at a free end of the boom 36. The excavation drum 38 is rotatably driven (e.g., by hydraulic motors) relative to the boom 36 about a drum axis 40 that is transverse relative to the central longitudinal axis 28. The excavation drum 38 carries a plurality of teeth 42 suitable for cutting rock. The boom 36 is pivotally moveable relative to the main chassis 22 about a boom pivot axis 44 that is transverse relative to the central longitudinal axis. The boom 36 can be pivoted about the boom pivot axis 44 between a lowered excavating position (see FIG. 1) and a raised transport position (see FIG. 2).

Figure 2:
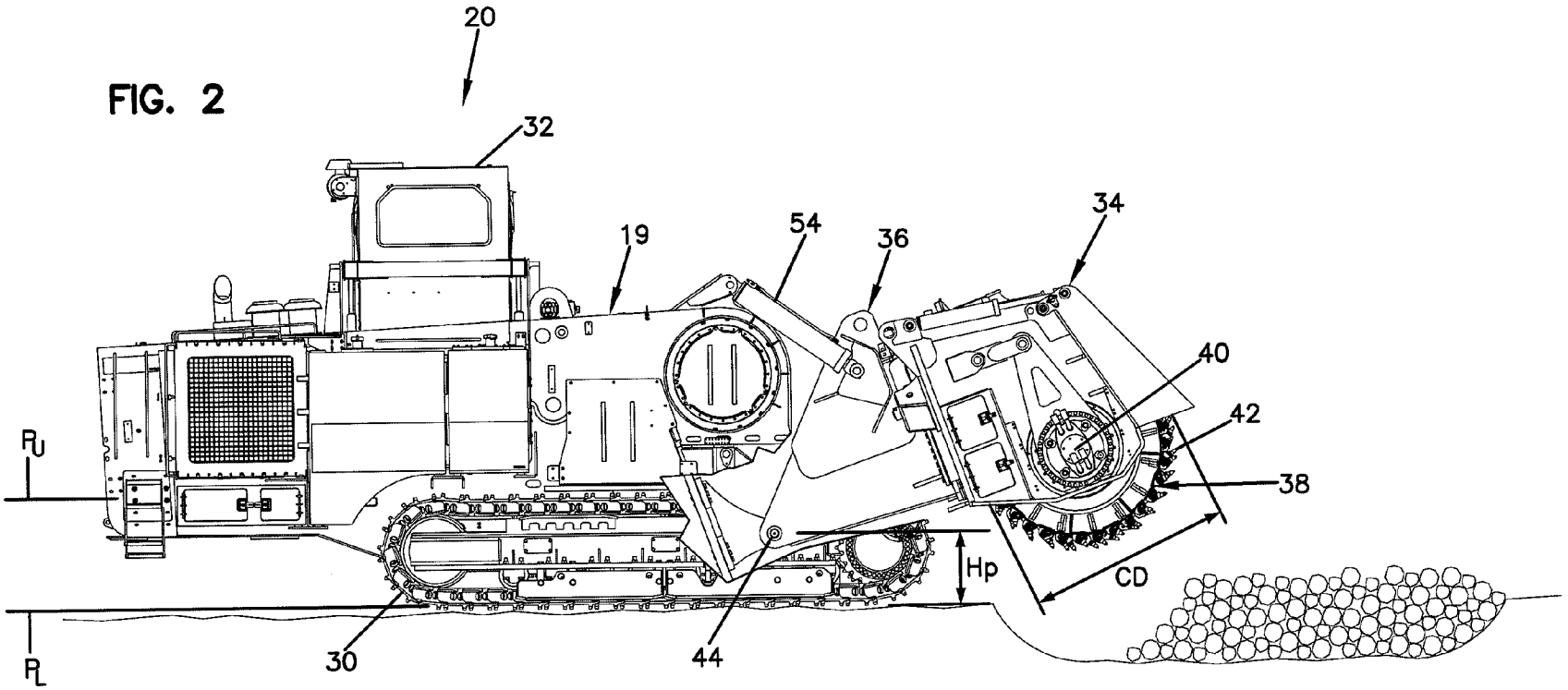
FIG. 2 is a side view of the surface excavation machine of FIG. 1 with the excavation tool in a transport position.
Figure 3:
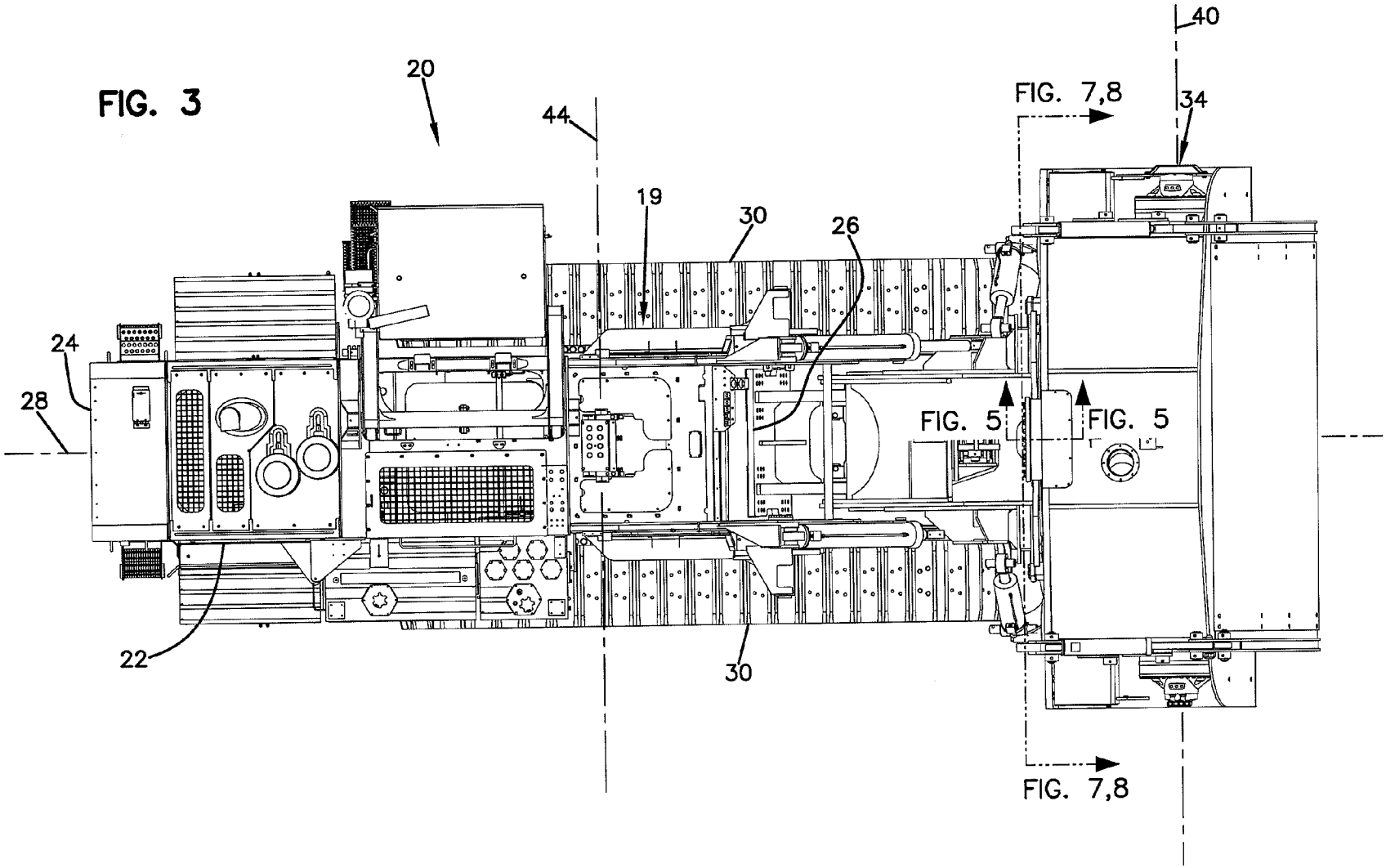
FIG. 3 is a top view of the surface excavation machine of FIG. 1.

In use of the surface excavation machine 20, the surface excavation machine 20 is moved to a desired excavation site while the excavation tool 34 is in the transport position of FIG. 2. When it is desired to excavate at the excavation site, the excavation tool 34 is lowered from the transport position to the excavation position (see FIG. 1). While in the excavation position, the excavation drum 38 is rotated in a direction 46 about the axis 40 such that the excavation drum 38 utilizes a down-cut motion to remove a desired thickness T of material. As the excavation machine 20 moves in a forward direction 47, excavated material passes under the drum 38 and is left behind the surface excavation machine 20. Preferably, the material left behind the excavation drum 38 has a generally uniform consistency. During the excavation process, the tracks 30 propel the surface excavation machine 20 in the forward direction 47 thereby causing a top layer of material having the thickness T to be excavated.

Figure 10:
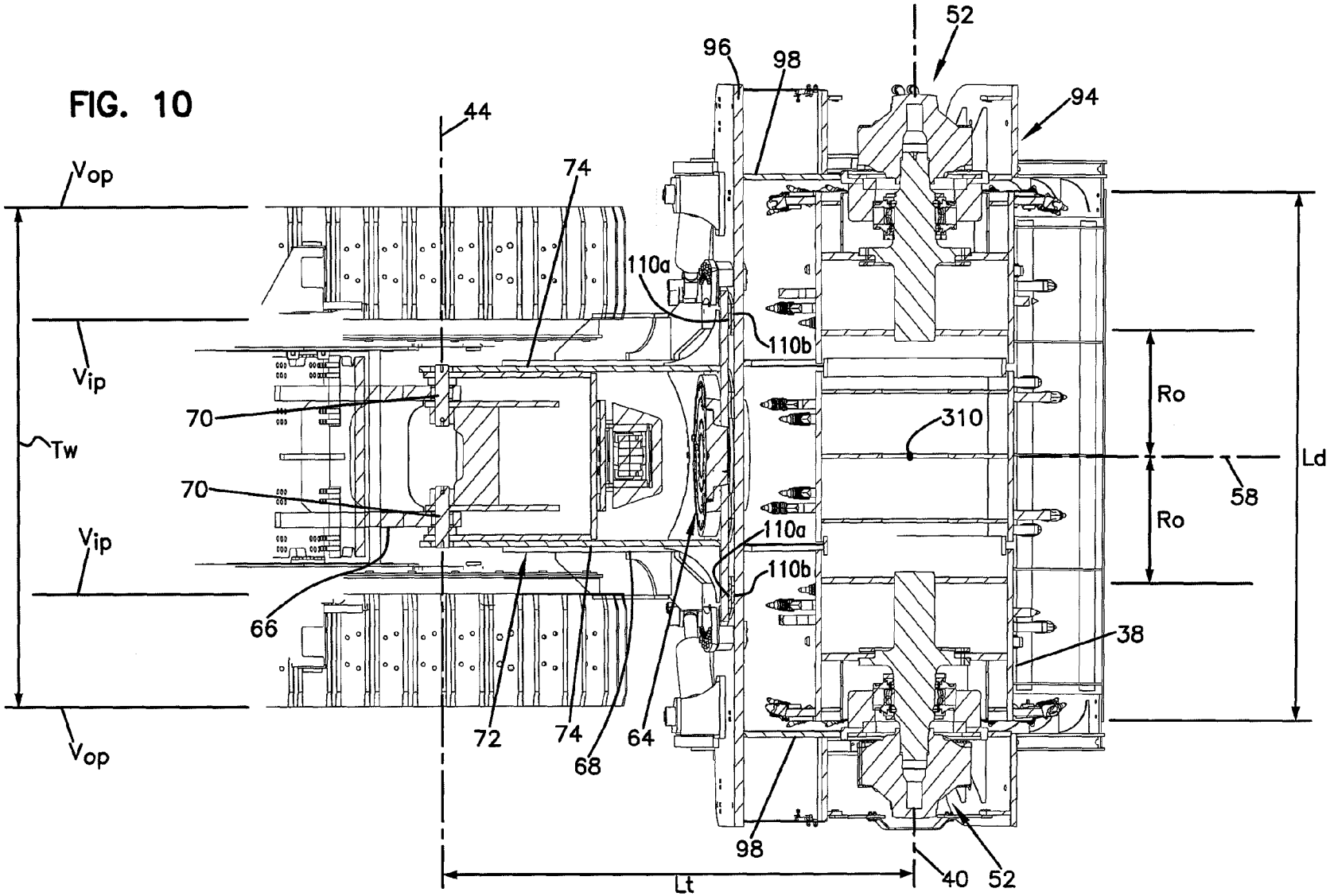
FIG. 10 is a top cross sectional view with a cross sectional plane of the view being taken along a horizontal plane that extends through the excavation tool of the surface excavation machine of FIG. 1.

It will be appreciated that the surface excavation machine 20 also includes a power unit 50 such as a diesel engine that provides power to the driven/drive components of the machine 20. In certain embodiments, the power unit 50 can provide power to a hydraulic system which transfers hydraulic power to various active components (e.g., hydraulic cylinders and hydraulic motors) of the machine 20. For example, hydraulic motors 52 (see FIG. 10) can be used for rotating the excavation drum 38 about the drum axis 40. Furthermore, hydraulic motors can be used to drive sprockets of the tracks 30. Moreover, the hydraulic system can be used to actuate numerous hydraulic cylinders for providing various pivoting and/or tilting functions. For example, hydraulic cylinders 54 are used to pivot the boom 36 about the boom pivot axis 44 between the excavating and transport positions. Also, hydraulic cylinders 56 are used to pivot the excavation drum 38 about a tilt pivot axis 58 (see FIGS. 7 and 8). The tilt pivot axis 58 is parallel to the central longitudinal axis 28 and is aligned along a plane that is generally perpendicular (i.e., perpendicular or almost perpendicular) relative to the pivot axis 44. The cylinders 56 pivot the excavation drum 38 about the tilt pivot axis 58 between a horizontal (i.e., non-tilted) orientation (see FIG. 7) and angled/tilted orientation (see FIG. 8).

Figure 4:
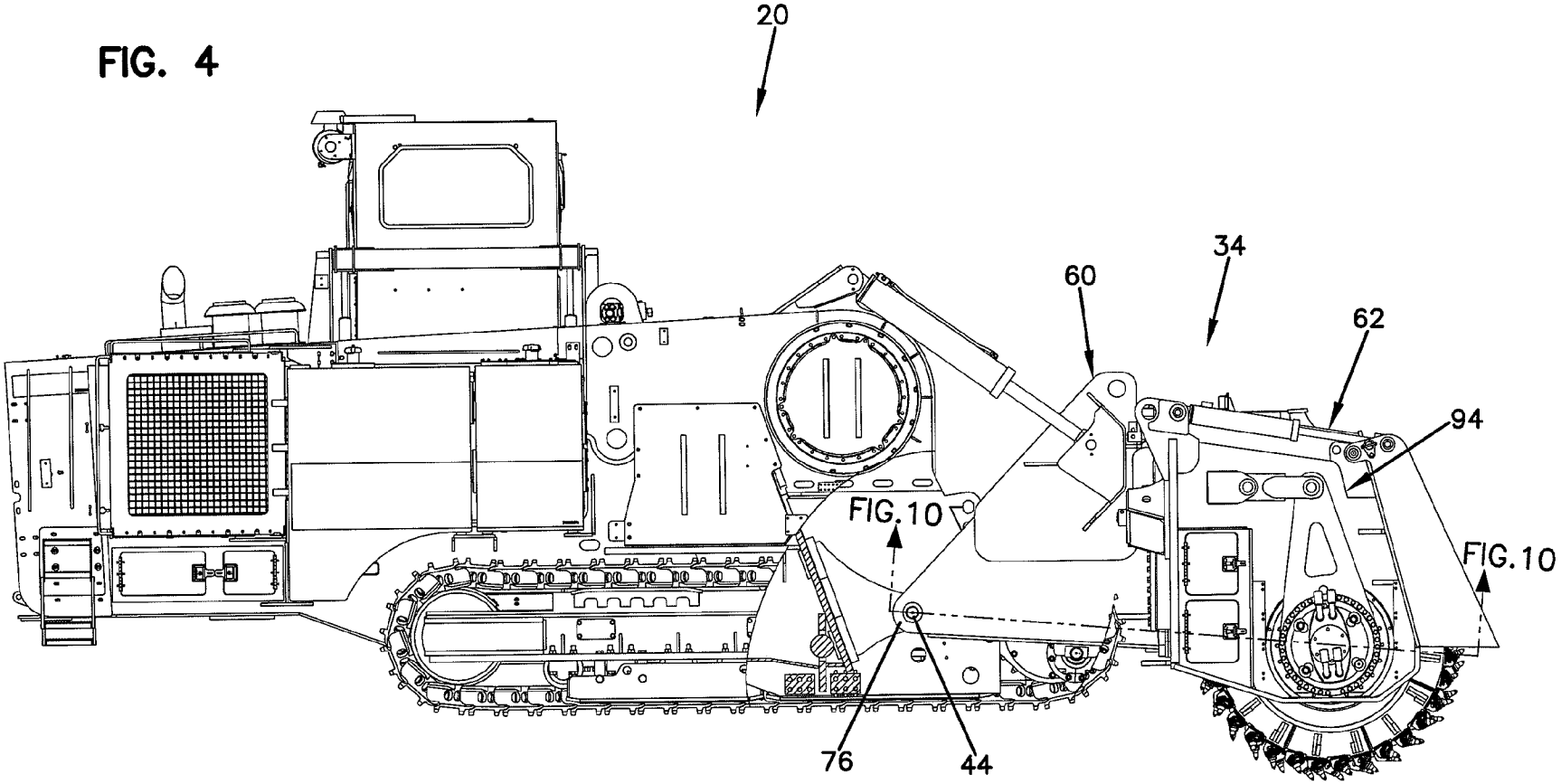
FIG. 4 is another side view of the surface excavation machine of FIG. 1.
Figure 6:
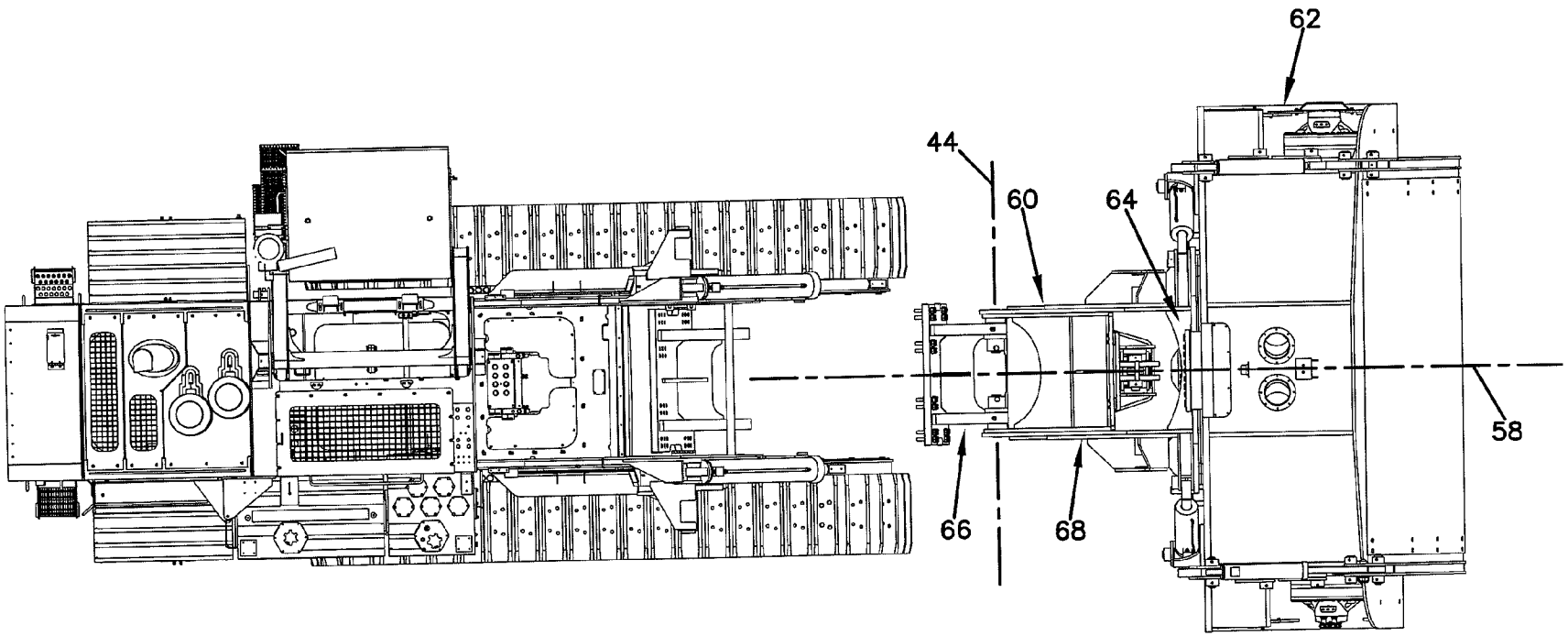
FIG. 6 is a top, plan view of the surface excavation machine of FIG. 1 with the excavation tool exploded from the main machine.

Referring to FIGS. 4 and 6, the excavation tool 34 of the surface excavation machine 20 includes a pivot sub-assembly 60 that connects to a drum sub-assembly 62 at a tilt pivot arrangement 64 defining the tilt pivot axis 58. The tilt pivot arrangement 64 has a compact configuration measured in a direction along a length of the excavation tool 34. The pivot sub-assembly 60 includes a front portion 66 configured to be fastened (e.g., bolted) to the rear of the main chassis 22 and a rear portion 68 that connects to the drum sub-assembly 62 at the tilt pivot arrangement 64. The front and rear portions 66, 68 of the pivot sub-assembly 60 are connected by pivot pins 70 aligned along the boom pivot axis 44. The pivot pins 70 allow the rear portion 68 of the pivot sub-assembly 60 to pivot relative to the front portion 66 of the pivot sub-assembly 60 about the boom pivot axis 44.

As shown at FIGS. 4, 7, 8, 10 and 11, the rear portion 68 of the pivot sub-assembly 60 includes a frame 72. The frame 72 is not free to rotate about the tilt pivot axis 58 since it is connected to the main chassis 22 via the front portion 66. The frame 72 includes opposing sidewalls 74 that are generally parallel (i.e., parallel or almost parallel) to the tilt pivot axis 58. As shown in the side view of FIG. 4, the sidewalls 74 are generally triangular (i.e., triangular or almost triangular). Lower front corners 76 of the sidewalls 74 are positioned at the boom pivot axis 44. Rear upright edges 78 of the sidewalls 74 are positioned adjacent the drum sub-assembly 64. The hydraulic cylinders 54 for pivoting the boom 36 about the boom pivot axis 44 have first ends 54*a* connected to the sidewalls 74 and second ends 54*b* connected to the main chassis 22. The connection points, of the first ends 54*a* of the cylinders 54, to the sidewalls 74 are located so that the entire length of the side of this triangular shape is effectively a lever arm, defining the ratio of the movement of the end of the hydraulic cylinders to the movement of the excavation tool. In the illustrated embodiment this ratio is approximately 0.58:1; for the excavation tool to move one inch the cylinder will need to retract or extend 0.58 inches. In addition the sidewalls 74 are reinforced with gussets at the connection points. The resulting mechanical advantage provided by the resulting lever arm, combined with the reinforced structure of the sidewalls 74 allows the two cylinders 54 to contribute to the rigidity of the rear portion 54.

Figure 5C:
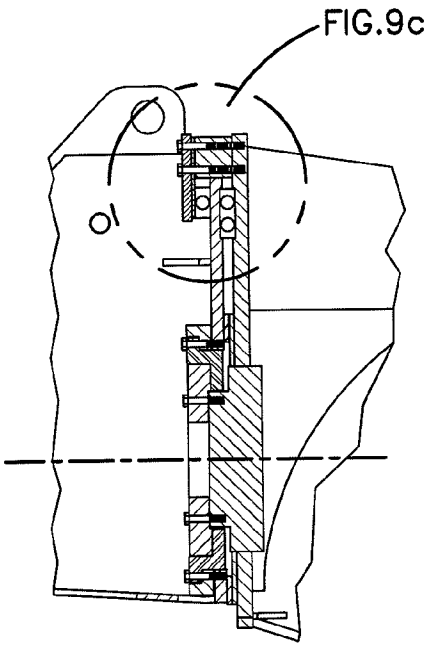
FIG. 5C is an assembled, partial cross sectional view of an alternative design for the excavation tool of the surface excavation machine of FIG. 1.
Figure 5B:
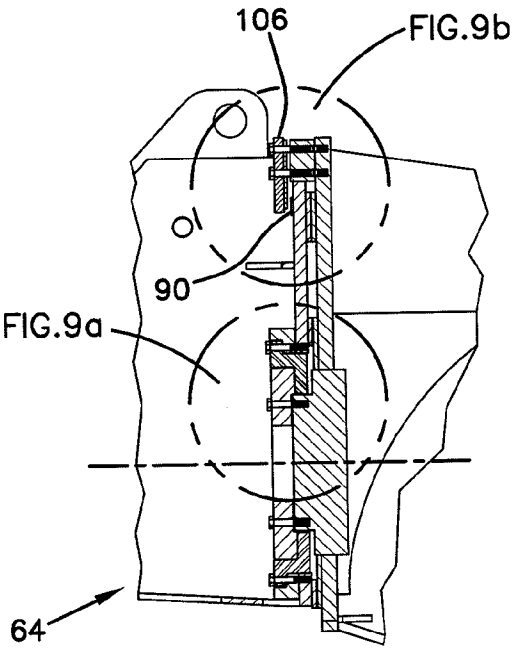
FIG. 5B is an assembled, partial cross sectional view of the excavation tool of the surface excavation machine of FIG. 1.
Figure 5A:
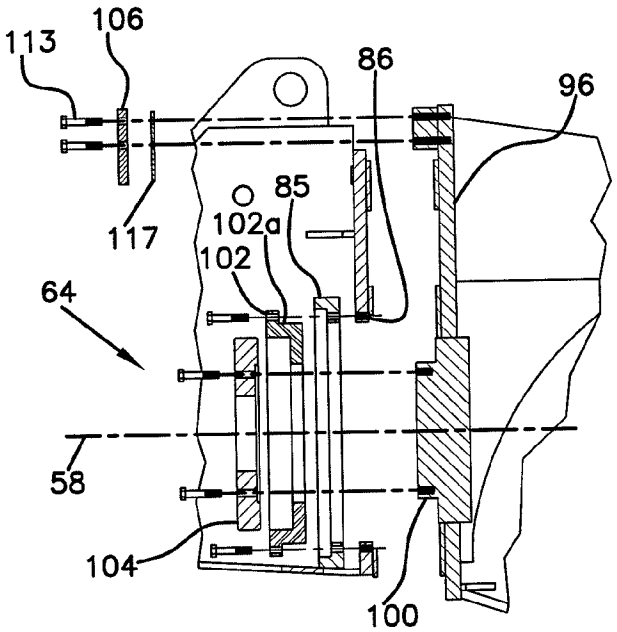
FIG. 5A is an exploded, partial cross sectional view of the excavation tool of the surface excavation machine of FIG. 1.

The frame 72 of the pivot sub-assembly rear portion 68 also includes a rear wall structure 80 that extends between and interconnects the sidewalls 74. The rear wall structure 80 is aligned transversely relative to the tilt pivot axis 58. Upper and lower walls 73, 75 can also be provided between the sidewalls 74 to form a box-like configuration suitable for further reinforcing the frame 72. The rear wall structure 80 includes a central portion 82 and lateral portions 84. The lateral portions 84 project laterally outwardly beyond the sidewalls 74 of the frame 72. As shown as FIGS. 7 and 8, the central portion 82 of the rear wall structure 80 defines a circular opening 86 (see FIG. 5A) that is centered about the tilt pivot axis 58. The lateral portions 84 of the rear wall structure 80 include reaction force members 88 (i.e., load bearing pads) having a radii of curvature that are centered about the tilt pivot axis 58. The central portion 82 of the rear wall structure 80 also includes a reaction force member 90 (i.e., a load bearing pad) having a radius of curvature centered about the tilt pivot axis 58. A plurality of reinforcing flanges 92 can be secured (e.g. welded) between the sidewalls 74 and the rear wall structure 80 for enhancing the structural integrity of the frame 72. An annular rim 85 having a forwardly facing inner shoulder 87 is secured (e.g., welded, fastened, etc.) to the front side of the rear wall structure 80 and cooperates with the rear wall structure 80 to define the opening 86.

The drum sub-assembly 62 includes a shroud or housing 94 that at least partially encloses an upper portion of the excavation drum 38. The housing 94 includes a front wall 96 that is generally perpendicular relative to the tilt pivot axis 58 and that is connected to the rear wall structure 80 of the pivot sub-assembly 60 by the tilt pivot arrangement 64. The housing 94 also includes sidewalls 98 that are generally parallel with respect to the tilt pivot axis 58. The hydraulic motors 52 for rotating the excavation drum 38 are mounted to the housing 94 adjacent the sidewalls 98. The tilt pivot arrangement 64 interconnects the drum sub-assembly 62 to the pivot sub-assembly 60 in such a way that the drum sub-assembly 62 has a range of pivotal motion relative to the pivot sub-assembly 60 about the tilt pivot axis 58. The tilt pivot arrangement 64 includes a cylindrical projection 100 secured (e.g., welded, fastened, etc.) to the front wall 96 of the housing 94 of the drum sub-assembly 62. The cylindrical projection 100 is centered about the tilt pivot axis 58. The tilt pivot arrangement 64 also includes an annular wear member 102 and an annular cap 104. The annular wear member 102 fits inside the annular rim 85 and is fastened to the rear wall structure 80 of the pivot sub-assembly. The annular wear member 102 includes a cylindrical portion 102*a*, a rear annular flange 102*b* that projects radially outwardly from the cylindrical portion 102*a* and a front annular flange 102*c* that projects radially inwardly from the cylindrical portion 102*a*. The rear annular flange 102*b* has a rear face that seats against the forwardly facing inner annular shoulder 87 of the rim 85. Fasteners 103 secure the annular wear member 102 to the rear wall structure 80. The fasteners 80 extend through aligned openings defined by the flange 102*b*, the shoulder 87 and the rear wall structure 80. The cylindrical portion 102*a* fits within the circular opening 86 defined by the rim 85 and the rear wall structure 80.

The cylindrical projection 102 fits within the annular wear member 102 such that the cylindrical projection 100 is free to rotate within the annular wear member 102 about the tilt pivot axis 58. The annular wear member 102 includes an inner cylindrical surface 102*d* that faces toward the tilt pivot axis 58. The surface 102*d* is concentric with the axis 58. The surface 102*d* is defined by an inner end of the flange 102*c*. The cylindrical projection 100 includes an outer cylindrical surface 100*a* that faces away from the tilt pivot axis 58 and that opposes the surface 102*d*. The surface 100*a* is concentric with the axis 58. A clearance exists between the surfaces 102*d*, 100*a* and the surface are typically not load bearing. Instead, radial load bearing takes place between the cap 104 and the wear member 102. The annular cap 104 of the tilt pivot arrangement 64 is fastened to the cylindrical projection 100 via fasteners 105. The cap 104 seats inside the wear member 102 and includes an outwardly facing cylindrical radial bearing surface 104*a* that opposes an inwardly facing cylindrical radial surface 102*e* defined by the cylindrical portion 102*a* of the annular wear member 102. The surfaces 104*a*, 102*e* are concentric with the axis 58. The cap 104 also includes a rearwardly facing axial bearing surface 104*b* that opposes a forwardly facing axial bearing surface 102*f* of rear flange 102*c* of the wear member 102. The surfaces 104*a*, 102*e* and 104*b*, 102*f* can be lubricated (e.g., by a packed grease arrangement 107) to facilitate allowing the surfaces to slide relative to one another when the projection 102 is rotated within the wear member 102. The flange 102*c* of the annular wear member 102 is captured between the annular cap 104 and a shoulder 100*c* the cylindrical projection 100.

The tilt pivot arrangement 64 allows for rotation of the cylindrical projection 100 about the tilt pivot axis 58 relative to the annular wear member 102, but limits or restricts movement of the cylindrical projection 100 relative to the annular wear member 102 along a plane P1 perpendicular to the tilt pivot axis 58. In this way, the annular wear member 102, the cylindrical projection 100 and the cap 104 limit lateral, upward and downward movement of the drum sub-assembly 62 relative to the pivot sub-assembly 60 while allowing pivotal movement of the drum sub-assembly 62 relative to the pivot sub-assembly 60 about the tilt pivot axis 58.

Figure 9C:
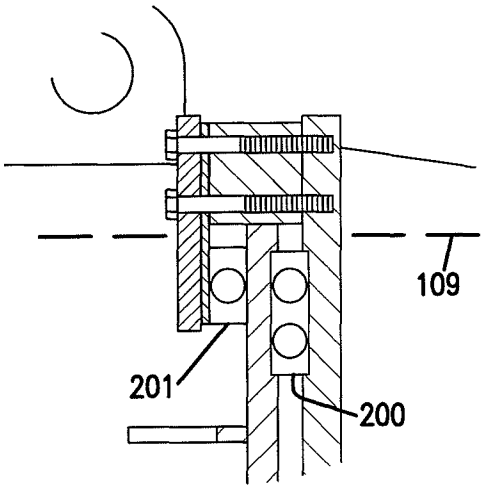
FIG. 9C is an enlarged view of a portion of FIG. 5C.
Figure 9B:
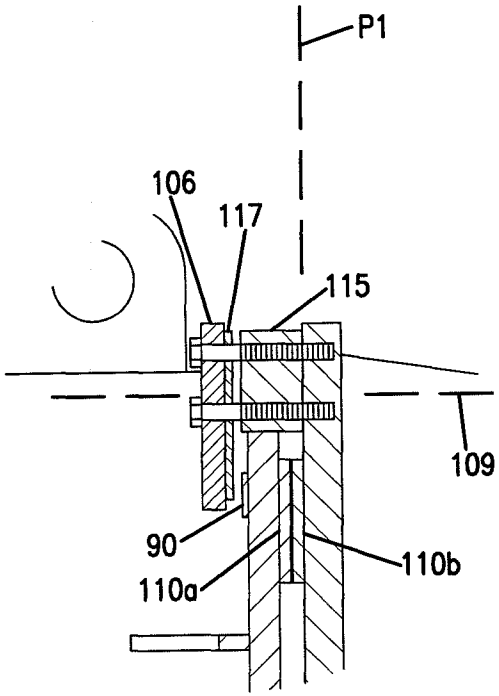
FIG. 9B is an enlarged view of a second portion of FIG. 5B.
Figure 9A:
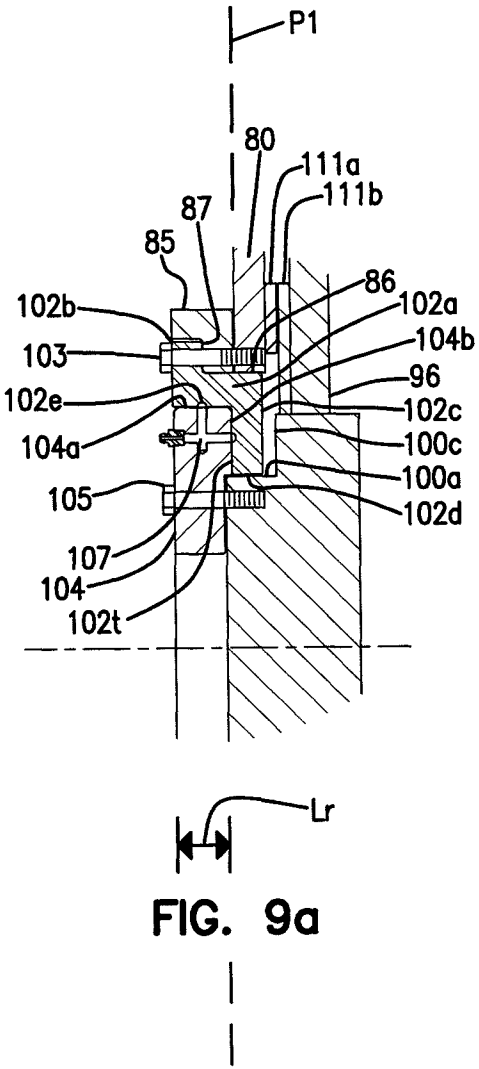
FIG. 9A is an enlarged view of a first portion of FIG. 5B.

As described above, the primary function of the cylindrical projection 100, the annular wear member 102 and the annular cap 104 is to allow pivotal movement of the drum sub-assembly 62 about the tilt pivot axis 58 while limiting relative movement along the plane P1 that is perpendicular to the tilt pivot axis 50. While surfaces 104*b* and 102*f* provide some resistance to axial loading, additional structure is provided for resisting relative movement between the drum sub-assembly 62 in the pivot sub-assembly 60 in an orientation 109 parallel to the tilt pivot axis 58 and/or resultant torque caused by such loading. For example, rear sets of outer opposing reaction members 110*a*, 110*b* (i.e., load bearing pads) are provided respectively on the rear side of the rear wall structure 80 of the pivot sub-assembly 60 and the front side of the front wall 96 of the drum sub-assembly 62. The members 110*a*, 110*b* respectively have forwardly and rearwardly facing reaction surfaces that abut one another and transfer load when the pivot sub-assembly 60 and the drum sub-assembly 62 are compressed together. In certain embodiments, the members 110*a*, 110*b* can be curved with a radius of curvature centered about the tilt pivot axis 58. The reaction force structures prevent forward movement of the drum sub-assembly 62 relative to the pivot sub-assembly 60. The reaction surface structures function to transfer loading applied between the pivot sub-assembly 60 and the drum sub-assembly 62 along the orientation 109 such that the cylindrical projection 100 and the annular wear member 102 need not be designed to fully handle such compressive loads. The loading transferred by such structures is the type that causes the pivot sub-assembly 60 and the drum sub-assembly 62 to be compressed together. Opposing annular rings 111*a*, 111*b* (i.e., reaction force members such as pads) positioned radially inside the members 110*a*, 110*b* also have opposing forwardly and rearwardly facing surfaces. The rings 111*a*, 111*b* assist the members 110*a*, 110*b* in transferring load between the drum sub-assembly 62 and the pivot sub-assembly 60 along the axial/longitudinal orientation 109. The opposing surfaces of the reaction force structures can be perpendicular relative to the tilt pivot axis 58. In other embodiments, ball bearing structures 200 can be provided between the opposing reaction force members 110*a*, 110*b* to facilitate movement thereinbetween (see FIGS. 5A and 9A).

Figure 7:
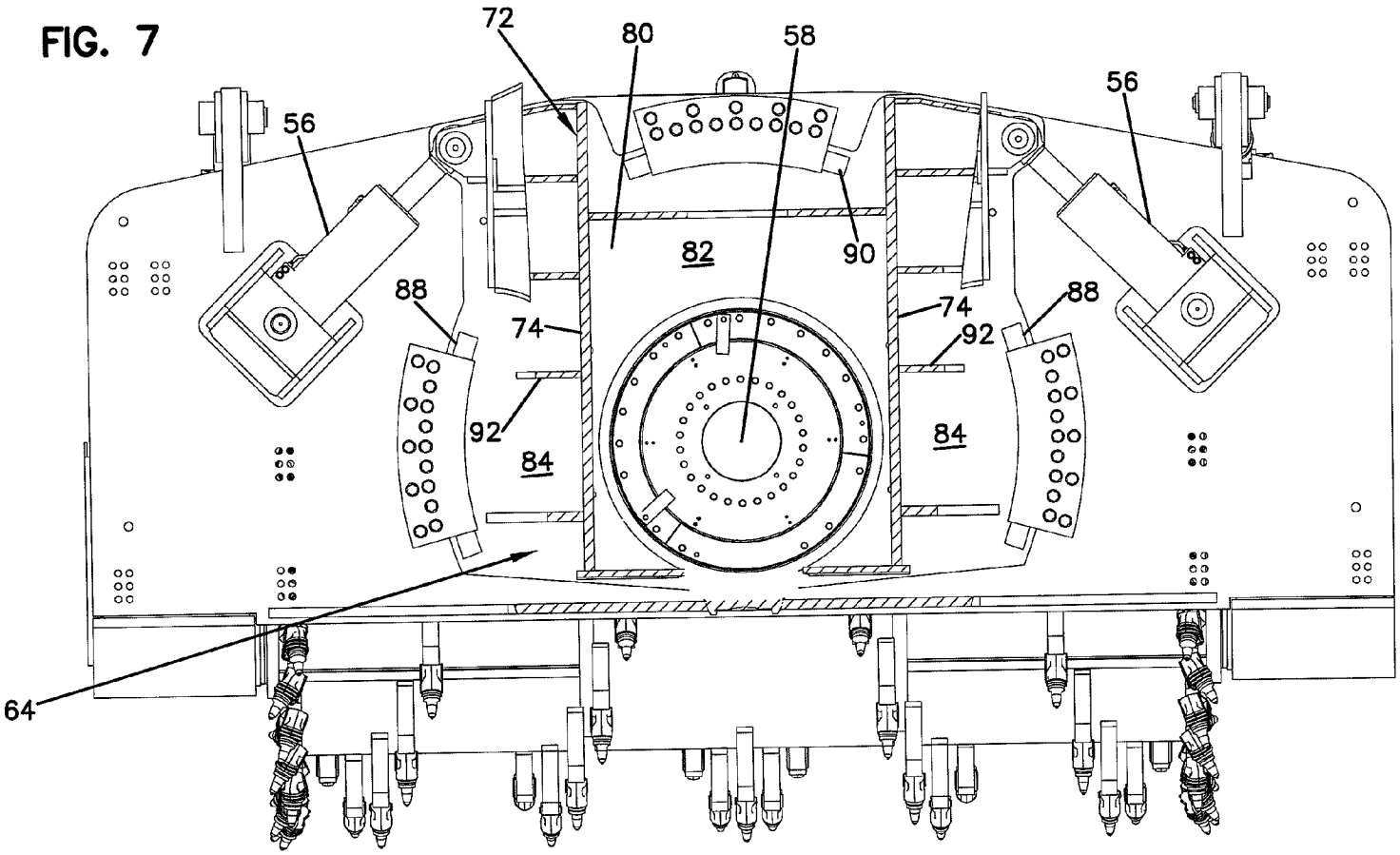
FIG. 7 is a cross sectional view taken along section line 7-7 of FIG. 3, a drum of the excavation tool is shown in a horizontal orientation.
Figure 8:
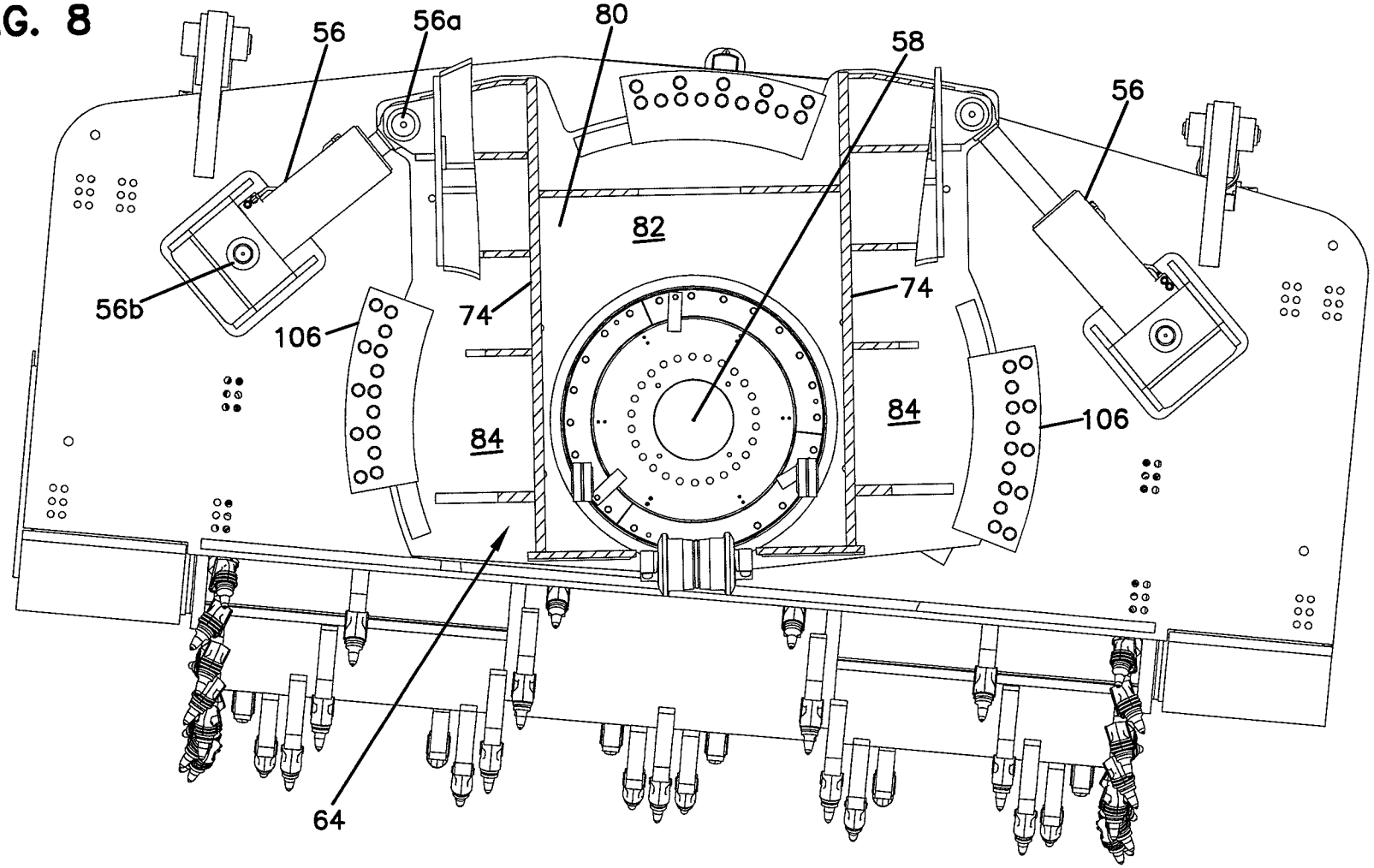
FIG. 8 is a cross sectional view taken along section line 8-8 of FIG. 3, the drum of the excavation tool is shown in a tilted orientation.

Referring to FIG. 7, the hydraulic cylinders 56 are used to pivot the drum sub-assembly 62 about the tilt pivot axis 58 relative to the pivot sub-assembly 60. The hydraulic cylinders 56 have first ends 56*a* connected to the rear wall structure 80 of the pivot sub-assembly 60 and second ends 56*b* connected to the front wall 96 of the drum sub-assembly 62.

Figure 11:
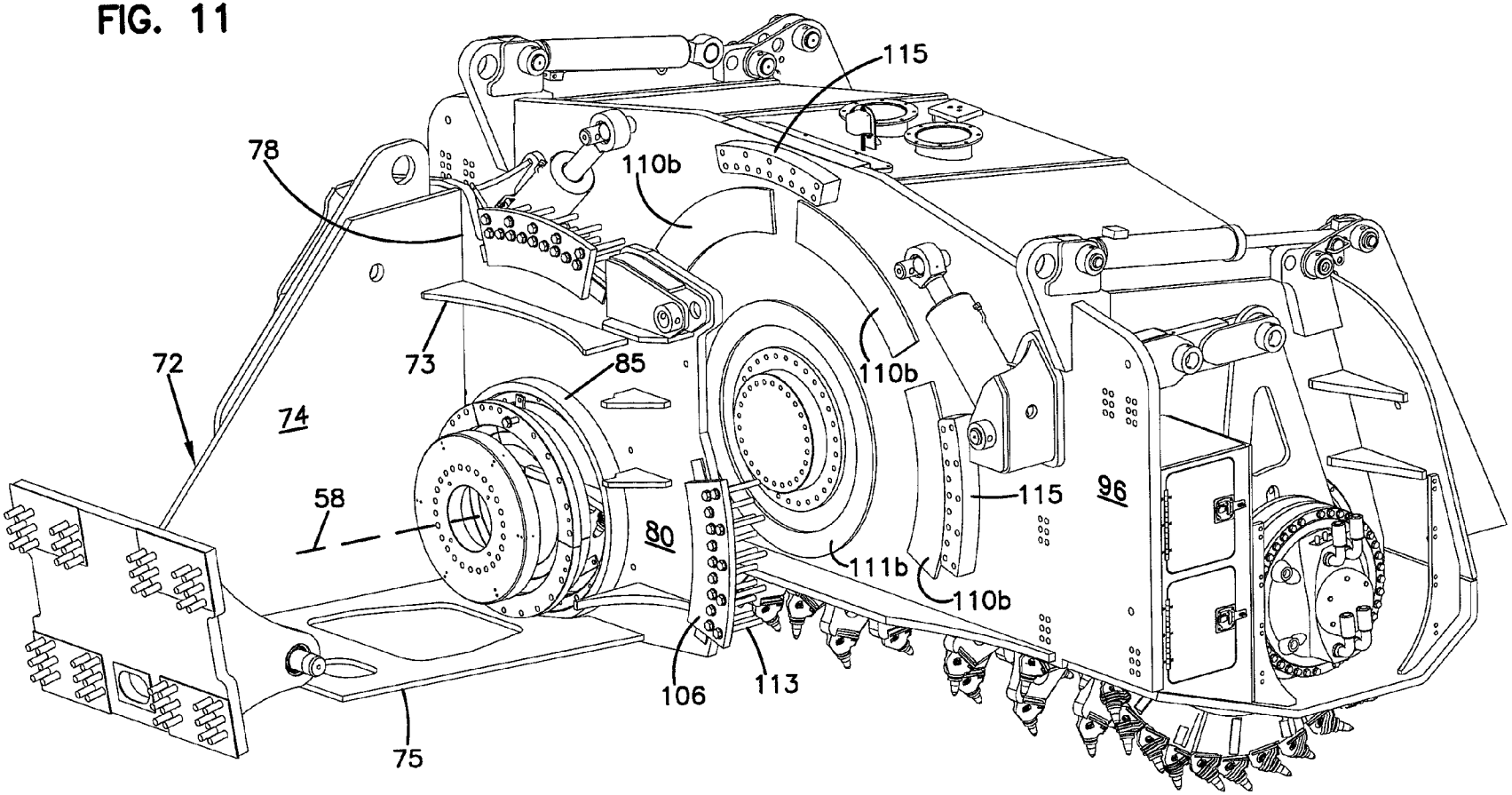
FIG. 11 is an exploded perspective view of a tilt pivot interface of the excavation tool of the surface excavation machine of FIG. 1.

Referring to FIGS. 7 and 11, the tilt pivot arrangement 64 further includes front structure for transferring loads between the pivot sub-assembly 60 and the drum sub-assembly 62 along the orientation 109. The loads transferred by the front structure are of the type which pull the pivot sub-assembly 60 and the drum sub-assembly 62 apart. The front structures include retention plates 106 are fastened (e.g. secured by bolts 113) or otherwise secured to offset blocks 115 secured at the front wall 96 of the drum sub-assembly 62. Inner portions of the retention plates 106 overlap the front side of the rear wall structure 80 such that the rear wall structure 80 is captured between the retention plates 106 and the front wall 96 of the drum sub-assembly 62. Reaction force members 117 (i.e., load bearing pads) are provided on rear sides of the retention plates 106. The reaction force members 117 have rear surfaces that oppose corresponding front surfaces of the reaction force members 88, 90 provided of the front side of the rear wall structure 80. When a load pulls the drum sub-assembly 62 away from the pivot sub-assembly 60 along the orientation 109, the reaction force members 117 compress against the reaction force members 88, 90. In this way, load is transferred between the assemblies 60, 62 along the orientation 109 thereby preventing the drum sub-assembly 82 from being moved rearwardly relative to the pivot sub-assembly 60. Because the reaction force members 117, 88 and 90 transfer this load, the cylindrical projection 100, the cap 104 and the annular wear member 102 need not be designed to handle such loads. The opposing surfaces of the reaction force members 88, 90, 117 can be perpendicular relative to the tilt pivot axis 58. In other embodiments, ball bearing structures 201 can be provided between the opposing reaction force members 117, 88 and between the reaction force members 117, 90 the facilitate movement thereinbetween. When the drum is torque loaded about a vertical axis 310 extending through a center of the drum 38, part of the torque loading is taken up by the front load transfer structures at one side of the tilt pivot axis 58 and another part of the torque loading is taken up by the rear load transfer structures at the opposite side of the tilt pivot axis.

By providing radially separated/distributed structures for restricting relative movement along the plane P1 and restricting movement in directions perpendicular to plane P1, a compact configuration along in a direction along the tilt pivot axis 58 can provided. For example, in the depicted embodiment, the structures for restricting relative movement in the orientation 109 are positioned radially outside the structures for restricting relative movement along the plane P1. In certain embodiments, at least some the structures for transferring load along the orientation 109 are positioned a radial offset distance Ro (see FIG. 10) from the tilt pivot axis 58 that is equal to or greater than at least 0.20 times a length Ld of the drum 38. In certain other embodiments, at least some the structures for transferring load along the orientation 109 are positioned a radial offset distance Ro (see FIG. 7) from the tilt pivot axis 58 that is equal to or greater than at least 0.30 times a length Ld of the drum 38. In the depicted embodiment, at least some of the structures for transferring load along the axis 109 are positioned at a radial offset distance Ro equal to about one-third the length Ld of the drum. In certain embodiments, at least some of the structures for transferring load along the orientation 109 are positioned outside vertical planes Vip defined by inner edges of the propulsion structures (e.g., the tracks 30) of the tractor 19 (see FIG. 10).

In certain embodiments, the excavation tool 34 is relatively large and heavy. For example, in one embodiment, the excavation tool 34 can have a weight that is at least 30% of the weight of the tractor 19. In other embodiments, the excavation tool 34 can have a weight that is in the range of 30% to 60% of the weight of the tractor 19. The relatively large weight of the attachment relates to the relatively long length Ld and large cutting diameter CD of the drum 38 (i.e., the diameter defined by the outer tips of the cutters as the drum 38 is rotated about the drum axis). In certain embodiments, the length Ld is greater than a track width Tw defined between vertical planes Vop defined by outer edges of the tracks 30 the surface excavation machine 20 including the excavation tool 34. In certain embodiments, the cutting diameter CD can be greater than 36 inches or greater than 72 inches or in the range of 72-120 inches.

Because the length Ld of the drum 38 is quite large, forces 300 applied to the ends of the drum 38 can generate substantial torque that is taken up by the tilt pivot arrangement. To accommodate this loading, prior art tilt pivot systems of the type disclosed at U.S. Pat. No. 7,290,360 utilize separate radial bearings separated from one another along the length of a relatively long shaft. The shaft provides a moment arm between the bearings that extends in a lengthwise direction and increases the overall length of the boom. The moment arm provided by the shaft reduces the overall loading applied to the bearings when a force is applied to one end of the drum 38. In contrast to the system disclosed in the '360 patent, the embodiments depicted herein do not utilize long pivot shafts for providing moment arms for counteracting torque generated at the drum 38. Instead, moment arms are provided by offsetting the axial load transfer structures radially outwardly from the tilt pivot radial bearing. By distributing the axial load bearing structures radially outwardly from the radial load bearing structure, the radial load bearing structure can be provided with a compact configuration in the axial orientation 109 while still being durable/robust enough to withstand the harsh operation conditions associated with surface excavation operations.

The radial load bearing structure provided by the cylindrical projection 100, the annular wear ring 102 and the cap 100 has a length Lr measured along the axis 58 that is less than 0.1 times the length Ld of the drum 38, or less than 0.05 times the length Ld. The length Lr is measured from a rearwardmost end of the radial load bearing structure to a forwardmost end of the radial load bearing structure. In other words, Lr is measured from the forwardmost location of any structure or structures utilized to provide radial bearing support about the tilt pivot axis 58 to a rearwardmost location of any structure utilized to provide radial bearing support about the tilt pivot axis 58. In the depicted embodiment, a single radial bearing structure defined by surfaces 104*a* and 102*e* is utilized.

In the surface excavation machine 20, the drum 38 is located at one end of the machine 20. This is advantageous because it allows excavation to occur in close proximity to an wall or other structure not desired to be excavated. However, by offsetting the drum 38 from the tractor 19 with a boom, the boom functions as a moment arm. The large weight of the drum combined with the length of the moment arm can negatively affect the maneuverability of the machine 20, particularly when the excavation tool is raised. Therefore, various structures disclosed herein (e.g., the compact tilt pivot arrangement) are configured to assist in shortening the boom length and thus the moment arm of the excavation tool 34. This assists in moving the center of gravity of the excavation tool 34 closer to the tractor 19. In certain embodiments, a length Lt of the excavation tool 34 measured between the drum axis 40 and the boom pivot axis 44 is less than 3 times the cutting diameter CD of the drum 38, or less than 2 times the cutting diameter CD of the drum 38.

It is preferred for the boom pivot axis 44 to be relative close to the ground. In some embodiments, the boom pivot axis is within 24 inches of the ground. As shown at FIG. 4, the propulsion structures (e.g., the tracks 30) define upper and lower horizontal planes Pu, $P_L$. The lower plane $P_L$ can be referred to as a ground contact plane. In certain embodiments, the boom pivot axis 44 is positioned below the upper plane Pu. In other embodiments, the boom pivot axis 44 is positioned at a height Hp above the lower plane $P_L$ that is less than a cutting diameter CD of the excavation drum 38, or less than 0.75 times the cutting diameter CD of the excavation drum 38, or less than 0.5 times the cutting diameter CD of the excavation drum 38, or less than 0.4 times the cutting diameter CD of the excavation drum 38, or less than 0.3 times the cutting diameter CD of the excavation drum 38. In certain embodiments, both the boom pivot axis 44 and the drum axis 40 are positioned lower than the tilt pivot axis 58.

In certain embodiments, the excavation drum 38 can cut to a cutting depth Dc below the lower plane $P_L$ of at least 0.1 times the cutting diameter CD of the excavation drum 38, or at least 0.2 times the cutting diameter CD of the excavation drum 38, or at least 0.3 times the cutting diameter CD of the drum 38. In certain embodiments, the tilt pivot axis 58 is positioned above the drum axis 40.

In certain embodiments, the drum 38 moves a height Hd equal to at least 0.5 times the cutting diameter CD when the boom moves between the excavating and transport positions. By lowering the boom pivot axis, the distance the boom projects rearwardly from the main chassis 22 when in the transport position can be reduced thereby improving maneuverability of the machine 20. This is true because once the boom has been pivoted to an orientation above the boom pivot axis 44, continued upward movement of the boom about the pivot axis 44 progressively shortens the horizontal distance the boom projects outwardly from the main chassis. In this way, the moment arm of the excavating tool 34 is reduced when the excavating tool is in the raised transport position.

It will be appreciated that the excavation tool 34 in the depicted embodiment is an attachment that can be interchanged with other attachments (e.g., trenching attachments) for use with the main chassis 22. For example, the excavation tool 34 can be quickly disconnected from the main chassis 22 by disconnecting the fasteners used to secure the front portion 66 of the pivot sub-assembly 60 to the main chassis. The tractor 19 includes another boom pivot location 300 for mounting a chain driven trenching boom of the type disclosed at U.S. Pat. No. 7,290,360. The tractor can be pre-configured to readily mount an additional hydraulic motor and other structures needed for driving the chains associated with such excavation tools.

Figure 12:
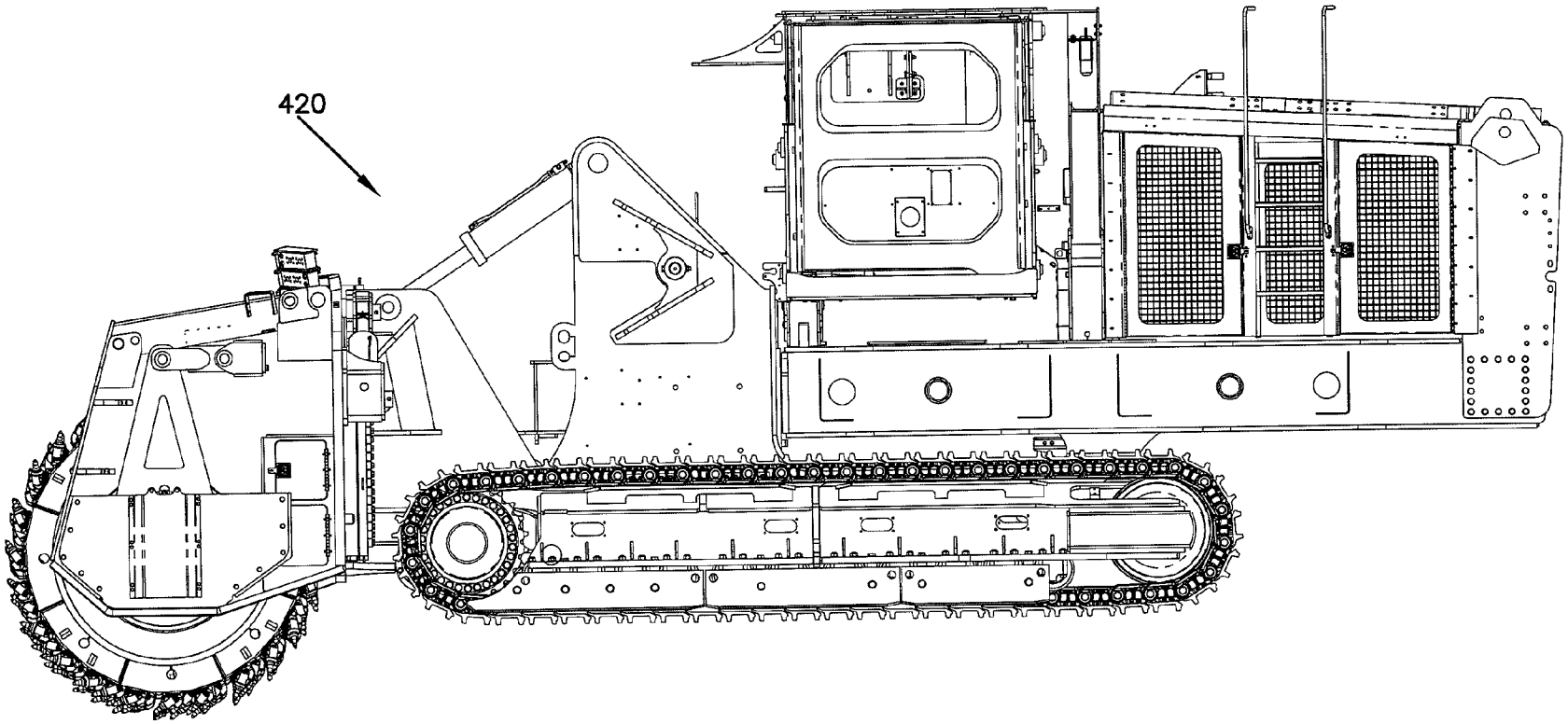
FIG. 12 is a side view of a surface mining machine having features in accordance with the principles of the present disclosure.

FIG. 12 shows another surface excavation machine 420 having features in accordance with the principles of the present disclosure. The machine is substantially larger that the machine 30 of FIG. 1 and is adapted for large scale surface mining applications.

The invention claimed is:

1. A surface excavating machine comprising:

a tractor including a main chassis supported on a ground drive system, the main chassis defining a central longitudinal axis that extends from a front end to a rear end of the main chassis, the ground drive system including propulsion structures defining a ground contact plane;

an excavation tool mounted at the rear end of the main chassis, the excavation tool including a drum rotatable about a drum axis, the drum carrying cutting teeth that define a cutting diameter when the drum is rotated about the drum axis, the drum being mounted adjacent a free end of a boom, and the drum having a drum length that extends from a first end to a second end of the drum;

a tilt pivot defining a tilt pivot axis for tilting the drum relative to the tractor between a first orientation where the first end of the drum is higher than the second end of the drum and a second orientation where the second end of the drum is higher than the first end of the drum;

a boom pivot defining a boom pivot axis about which the boom can be pivoted to raise and lower the drum between a transport position and an excavation position, the boom pivot axis being spaced a pivot height above the ground contact plane, the pivot height being less than or equal to 0.5 times the cutting diameter of the drum.

2. The surface excavating machine of claim 1, wherein a first distance is defined between the boom pivot axis and the drum axis, and wherein the first distance is less than or equal to 2 times the cutting diameter of the drum.

3. The surface excavating machine of claim 1, wherein the tilt pivot includes a radial bearing arrangement having a bearing length defined between a forwardmost end of the bearing arrangement and a rearwardmost end of the bearing arrangement, and wherein the bearing length is less than 0.1 times the drum length.

4. The surface excavating machine of claim 1, wherein the propulsion structures include tracks, wherein the tracks have inner edges that define inner vertical planes, wherein the tracks have outer edges that define outer vertical planes, and wherein the drum length is longer than a distance between the outer vertical planes.

5. The surface excavating machine of claim 4, wherein the excavation tool includes a boom pivot sub-assembly and a drum sub-assembly, the drum being mounted to the drum sub-assembly, the boom pivot sub-assembly and the drum sub-assembly being connected by the tilt pivot, the boom pivot sub-assembly extending from the tilt pivot to the boom pivot, the tilt pivot including a radial bearing arrangement for allowing the drum sub-assembly to pivot about the tilt pivot axis relative to the pivot sub-assembly, the radial bearing arrangement limiting movement of the drum sub-assembly relative to the boom pivot sub-assembly in a plane perpendicular to the tilt pivot axis, the tilt pivot further including force transfer structures for transferring forces between the drum sub-assembly and the boom pivot sub-assembly in an orientation parallel to the tilt pivot axis, the force transfer structures being radially outwardly offset from the radial bearing arrangement.

6. The surface excavating machine of claim 5, wherein the force transfer structures are located at least partially outside inner vertical planes defined by the tracks.

7. The surface excavating machine of claim 5, wherein the force transfer structures are radially outwardly offset from the radial bearing arrangement by a distance equal to at least 0.2 times the drum length.

8. The surface excavating machine of claim 1, wherein the boom pivot axis is a first boom pivot axis and the excavation tool is a first excavation tool, wherein the first excavation tool can be replaced with a second excavation tool, and wherein the tractor defines a second boom pivot axis for use with the second excavation tool, the second pivot axis being offset from the first pivot axis.

9. The surface excavating machine of claim 1, wherein the pivot height is less than or equal to 0.4 times the cutting diameter of the drum.

10. The surface excavating machine of claim 6, wherein the radial bearing arrangement has a bearing length defined between a forwardmost end of the bearing arrangement and a rearwardmost end of the bearing arrangement, and wherein the bearing length is less than 0.1 times the drum length.

* * * * *